United States Patent [19]

Hoshino et al.

[11] Patent Number: 4,550,487

[45] Date of Patent: Nov. 5, 1985

[54] PROCESS FOR PREPARING STRIPS OR SHEETS OF HIGH STRENGTH AUSTENITIC STEEL HAVING IMPROVED FATIGUE STRENGTH

[75] Inventors: Kazuo Hoshino; Teruo Tanaka; Kenjiro Ito, all of Yamaguchi, Japan

[73] Assignee: Nisshin Steel Company, Ltd., Japan

[21] Appl. No.: 425,621

[22] Filed: Sep. 28, 1982

[30] Foreign Application Priority Data

Oct. 21, 1981 [JP] Japan ..... 56-167059

[51] Int. Cl.[4] ..... B23P 17/00

[52] U.S. Cl. ..... 29/527.7; 51/135 R; 148/2; 148/12 E; 148/38

[58] Field of Search ..... 29/527.7; 148/12 E, 148/38, 2, 4; 51/135 R, 137, 138, 139

[56] References Cited

U.S. PATENT DOCUMENTS

| | | | |
|---|---|---|---|
| 675,209 | 5/1901 | Godfrey | 51/135 R |
| 1,998,770 | 4/1935 | Schulte | 51/138 X |
| 3,284,250 | 11/1966 | Yeo et al. | 148/38 X |
| 3,309,242 | 3/1967 | Pops | 148/38 |
| 3,516,874 | 6/1970 | Maker et al. | 148/4 |
| 3,844,846 | 10/1974 | Friske et al. | 148/12 E X |

OTHER PUBLICATIONS

B. E. Boardman, "Fatigue Resistance of Steels"; *Metals Handbook Ninth Edition;* vol. 1, Properties and Selection: Irons and Steels; American Society for Metals, Metals Park, Ohio, (1978); pp. 665–682.

J. A. Pope, Metal Fatigue, Chapman & Hall Ltd., London, England, (1959), pp. 1–4.

*Primary Examiner*—Howard N. Goldberg
*Assistant Examiner*—Ronald S. Wallace
*Attorney, Agent, or Firm*—Webb, Burden, Robinson & Webb

[57] ABSTRACT

In the conventional process of manufacturing sheets of metastable austenitic stainless steel, a mechanical polishing step is included before or after the final temper rolling step. By insertion of this step, the fatigue resistance of the produced steel strips and sheets is remarkably improved.

1 Claim, 1 Drawing Figure

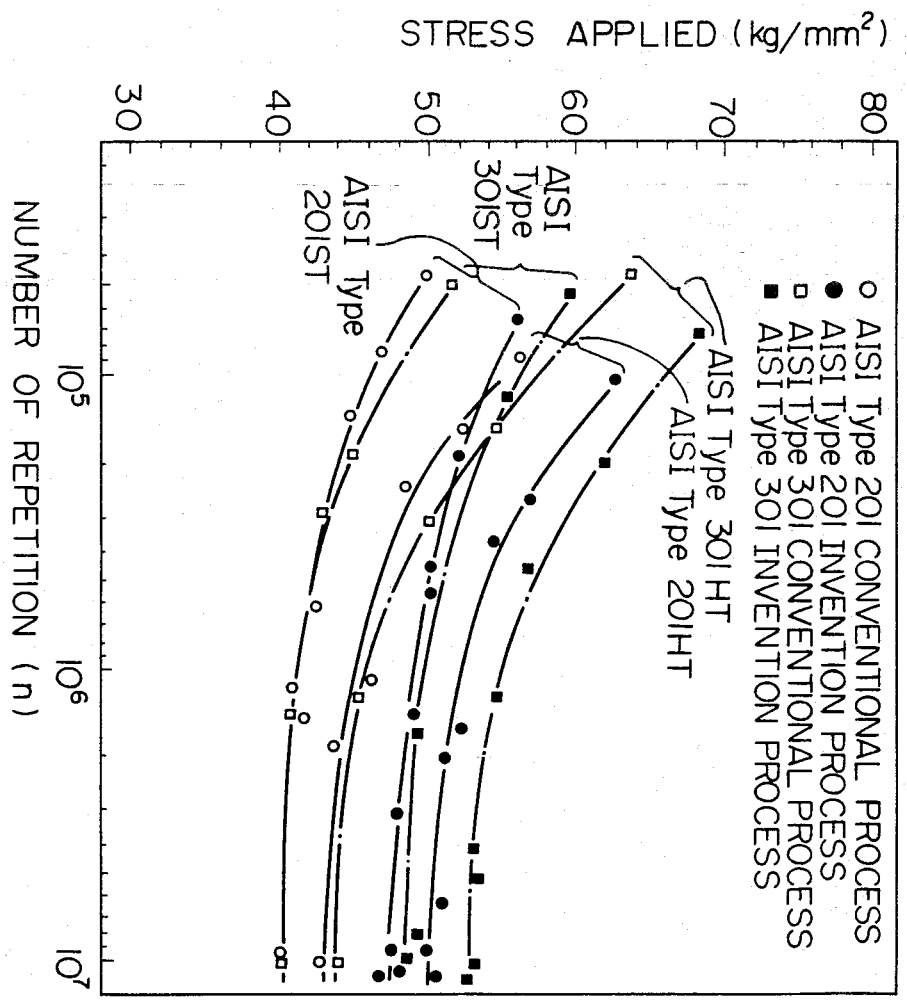
STRESS APPLIED (kg/mm²)
80
70
60
50
40
30
○ AISI Type 201 CONVENTIONAL PROCESS
● AISI Type 201 INVENTION PROCESS
□ AISI Type 301 CONVENTIONAL PROCESS
■ AISI Type 301 INVENTION PROCESS
AISI Type 301 HT
AISI Type 201HT
AISI Type 301ST
AISI Type 201ST
10⁵
10⁶
10⁷
NUMBER OF REPETITION (n)

PROCESS FOR PREPARING STRIPS OR SHEETS OF HIGH STRENGTH AUSTENITIC STEEL HAVING IMPROVED FATIGUE STRENGTH

TECHNICAL FIELD OF THE INVENTION

This invention relates to a process for preparing strips or sheets of high strength metastable austenitic stainless steel such as AISI Type 301 (SUS 301 in JIS), AISI Type 201 (SUS 201 in JIS), etc. having improved fatigue strength, in which the strength of the materials is improved by temper rolling and the characteristic surface luster of the cold-rolled sheets is not impaired.

BACKGROUND OF THE INVENTION

Conventionally, plain carbon steels or low-alloy steels are used in the manufacturing of railroad vehicles. With these materials, in order to secure the strength required of materials for railroad vehicles, considerably thick sheets are used, which makes the weight of the vehicles heavy. Also vehicles made of these materials require painting for the purpose of protection against corrosion. Thus, much labor is required and much expense is incurred for periodical painting.

Nowadays, however, temper-rolled sheets of high strength metastable austenitic stainless steels such as AISI Type 301 (SUS 301 in JIS), AISI Type 201 (SUS 201 in JIS), etc. are being used more and more for manufacturing railroad vehicles. Sheets of these steels have excellent anti-corrosion property and acquire high strength by cold rolling. By employment of these materials, railroad vehicles are made lighter and require less maintenance cost with a consequent great benefit in saving energy and material resources.

Under the circumstances, expanded use of these materials is expected from now on. When these materials are used for railroad vehicles, however, they must be provided with a wider range of characteristics than when they are used for general purposes. That is, they must be of high strength, have considerably good cold workability, and also are required to have workhardenability because of the strength level required thereof. Further, they must be provided with excellent fatigue strength, because materials for railroad vehicles are subjected to high-frequency vibration.

In the course of our study to develop sheets of high strength metastable austenitic stainless steels for railroad vehicles with improved resistance to fatigue without sacrificing strength, workability, workhardenability and corrosion resistance, we have found the process of this invention.

Conventionally, stainless steel sheets are manufactured by annealing and pickling hot-rolled strips, cold-rolling the pickled strips (intermediate annealing optionally included), annealing and pickling or brightannealing the rolled strips, and finally temper-rolling them.

We have found that it is possible to unexpectedly enhance the fatigue strength of the products in the abovementioned process by including a mechanical polishing step, which step has not been employed in the later stage of the cold rolling.

This invention provides in the process for preparing cold-rolled strips or sheets of metastable austenitic stainless steel comprising casting a melt of the steel, producing a hot strip therefrom, annealing and pickling the obtained hot strip, cold-rolling the hot-rolled strip, wherein pickling and annealing are properly inserted, and finally temper-rolling the obtained sheets, an improved process for producing steel sheets with improved fatigue resistance characterized in that a mechanical polishing step is included before or after temper rolling.

In the process of this invention, when bright annealing is employed as the final annealing, no final pickling is required.

The polishing step may be included either before or after the temper rolling. However, it is preferable to carry out the polishing before the temper rolling for better smoothness and luster of the products.

In the process of this invention, mechanical polishing is effected by belt polishing, shot peening with glass beads or steel particles, buffing, etc. These methods are known per se. The degree of the polishing is preferably several microns to some 15 microns. The usually employed polishing conditions give good results. Practically, the mechanical polishing can conveniently be conducted by way of belt polishing.

By the process of this invention, strips or sheets of metastable austenitic stainless steels represented by AISI Type 301, AISI Type 201, etc., can be improved in their mechanical properties, especially in their fatigue characteristics.

The reason why employment of a mechanical polishing step in the course of manufacturing cold-rolled steel sheets improves fatigue characteristics of the produced steel sheets is not yet well understood. Probably it is among the reasons that the surface defects which have been caused in the steps prior to the final annealing and pickling and the newly caused intergranular erosion during the final annealing and pickling, which will constitute the starting points of fatigue cracking, are removed by polishing, and the effect of polishing per se and some thermomechanical effect resulting therefrom will contribute to improvement in the fatigue characteristics.

This invention is applicable to the hot strips made by conventional casting as well as continuous casting. Today continuous casting is widely employed and it should be understood that the process of this invention is more commonly applied to the continuous casting hot strips, although the embodiments described hereinafter are described with respect to conventional casting hot strips because of the laboratory scale practice.

Now the invention is explained specifically by way of working examples with reference to the attached drawings.

BRIEF DESCRIPTION OF THE DRAWINGS

The attached drawing shows the fatigue strength of cold-rolled sheets of AISI Type 301 steel and AISI Type 201 steel obtained in accordance with the conventional process and the process of this invention.

DETAILED DESCRIPTION OF THE EMBODIMENTS OF THE INVENTION

An AISI Type 301 steel heat and an AISI Type 201 steel heat of the standard composition were melted, cast, bloomed and hot-rolled into 3.8 mm thick hot strips by the conventional process. The compositions of the steel heats are given in the following Table 1.

TABLE 1

| Steel | C | Si | Mn | P | S | Ni | Cr | N |
|---|---|---|---|---|---|---|---|---|
| 301 | 0.060 | 0.54 | 1.02 | 0.025 | 0.005 | 7.23 | 16.94 | — |

TABLE 1-continued

| Steel | C | Si | Mn | P | S | Ni | Cr | N |
|---|---|---|---|---|---|---|---|---|
| 201 | 0.065 | 0.52 | 6.24 | 0.028 | 0.006 | 4.52 | 16.54 | 0.14 |

The two kinds of hot-rolled strips obtained were each divided into two groups. One half of each was worked in accordance with this invention, and the other half was worked in accordance with the conventional process, both into H.T. sheets and S.T. sheets, respectively.

The working steps were the same for both the AISI Type 301 steel and the AISI Type 201 steel. The H.T. (hard-tempered) sheets were prepared by annealing and pickling the hot-rolled strip (3.8 mm thick), cold-rolling it down to 2.78 mm, annealing and pickling again and finally temper-rolling down to 2.00 mm thickness in accordance with the conventional process. In the process of this invention, however, a belt polishing step was included before the temper rolling.

The S.T. (soft-tempered) sheets were prepared by annealing and pickling the hot-rolled strip (3.8 mm thick), reducing the thickness down to 2.78 mm by the primary cold rolling, further reducing the thickness down to 2.28 mm by the secondary cold rolling after the inserted annealing and pickling, repeating the annealing and pickling and finally temper-rolling the sheet down to 2 mm thickness in accordance with the conventional process. In the process of this invention, however, a belt polishing step was included before the temper rolling.

The mechanical properties and fatigue characteristics of the thus prepared cold-rolled sheets were measured. The mechanical properties are summarized in Table 2. The fatigue characteristics were determined and evaluated by the reversed plane bending fatigue test using a Schenck type fatigue testing machine. The results are summarized in the attached drawing.

TABLE 2

| Steel | Temper | Mechanical Properties of Samples Sheets: Yield Strength 0.2% off-set ($Kg/mm^2$) | Tensile Strength ($Kg/mm^2$) | Elongation (%) | Bending (radius of curvature when bent at 180°) | Fatique Limit ($Kg/mm^2$) |
|---|---|---|---|---|---|---|
| Conventional Process | | | | | | |
| AISI | HT | 74.5 | 99.6 | 28.5 | ½ T ND | 43.6 |
| 301 | ST | 53.9 | 87.6 | 37.2 | 0 T ND | 40.1 |
| AISI | HT | 79.6 | 111.5 | 25.3 | 1 T ND | 43.0 |
| 201 | ST | 48.2 | 95.6 | 38.5 | 0 T ND | 40.1 |
| Invention Process | | | | | | |
| AISI | HT | 76.2 | 101.2 | 27.9 | ½ T ND | 52.6 |
| 301 | ST | 54.3 | 89.1 | 35.6 | 0 T ND | 48.4 |
| AISI | HT | 79.0 | 110.9 | 24.9 | 1 T ND | 50.0 |
| 201 | ST | 49.0 | 95.8 | 37.9 | 0 T ND | 47.2 |

T: thickness
ND: no defect

As is apparent from the table and the drawing, there are no differences found between the cold-rolled sheets of the conventional process and those of the process of this invention in 0.2% off-set yield strength, tensile strength, elongation and bending property. But the products of this invention generally exhibit an enhancement of 7–9 $kg/mm^2$ in fatigue resistance, and also an enhancement of 7–9 $kg/mm^2$ in fatigue limit.

Industrial Applicability

This invention produces stainless steel sheets with improved fatigue resistance suitable for manufacturing railroad vehicles by addition of a simple working step to the conventional process. Therefore, only a very small additional cost is required for producing materials with improved fatigue resistance.

What is claimed is:

1. In the process for preparing cold-rolled strips or sheets of metastable austenitic stainless steel for use in the manufacture of rolling stock subject to high frequency vibrations comprising the known steps of casting a melt of the steel, producing a hot strip therefrom, annealing and pickling said hot strip, cold-rolling the hot-rolled strip, wherein pickling and annealing are properly performed, and finally temper-rolling the obtained sheets, an improved process for producing steel sheets with improved fatigue resistance characterized in that the mechanical polishing step of belt polishing is included before temper-rolling.

* * * * *